United States Patent [19]

Ehrenfels et al.

[11] Patent Number: 5,035,646

[45] Date of Patent: Jul. 30, 1991

[54] FLUSH MOUNTED RECEPTACLE AND PLUG WITH PIN AND SLEEVE TYPE CONTACTS

[75] Inventors: Alfred L. Ehrenfels, Cheshire; David Lutz, North Branford, both of Conn.; Martin Parker, Ava, N.Y.

[73] Assignee: Hubbell Incorporated, Orange, Conn.

[21] Appl. No.: 545,945

[22] Filed: Jun. 29, 1990

[51] Int. Cl.[5] ..... H01R 13/74

[52] U.S. Cl. ..... 439/536; 248/906

[58] Field of Search ..... 439/536, 537, 535, 538, 439/539, 562, 564, 281; 248/27.1, 906

[56] References Cited

U.S. PATENT DOCUMENTS 2,843,642 7/1958 Manzella ..... 439/538
3,083,347 3/1967 Fahey, Jr. ..... 439/538

OTHER PUBLICATIONS

Brochure entitled "Hubbell Pin and Sleeve System", Hubbell, Inc., Wiring Device Division, Industrial Products Group, Bridgeport, Conn. 06605-0933 (1988).
Brochure entitled, "ABL17", ABL Bayerische Elektrozubehör GmbH and Co. KG, Lauf/Pegnitz, Germany (22 pp.), Publication date unknow).
Brochure entitled "CEKON Winkelstecker, Steckdosen und Steckvorrichtungen Typ F", Lindner GmbH, Bamberg, Germany (4 pp.); (1981).
Brochure entitled "das Flachsystem-eine neue Alternative", Elektra Tailfingen Schalgeräte GmbH and Co. KG, Albstadt, Germany (4 pp); (1982).
Brochure page entitled, "CEEtype Mondo", Walther Werke, Ferdinand Walther GmbH, Eisenberg, Germany (2 sides); (1981).
Brochure page entitled, "Berker CEE Industrie-Steckvorrichtungen", Gebr. Berker GmbH and Co., Schalksmühle, Germany (2 sides) Publication date unknown).

*Primary Examiner*—Gary F. Paumen
*Attorney, Agent, or Firm*—Jerry M. Presson; Walter C. Farley

[57] ABSTRACT

A pin and sleeve receptacle is mountable in a wall box recessed in a wall opening of a building with wires extending into the box from an in-wall wiring passage. The receptacle has a tubular electrically non-conductive shell closed at one end, the other end being open and a flange with fastener openings at the open end of the shell. A cylindrical inner body has an outer diameter smaller than the first inner diameter, the inner body having female connector sleeves for receiving electrically conductive pins of a mating plug. The inner body is mounted within the shell with an annular gap surrounding the inner body for receiving the shroud of the pin-and-sleeve plug. The opening at one end face the same direction as the open end of the shell to receive the pins of the plug. Apertures in the shell admit wires from the box for connection to the electrically conductive female connectors. An adapter plate has a central opening to receive the shell, holes to receive fasteners extending through the fastener openings in the flange and holes to permit passage of fasteners for mounting the plate across the opening of the recessed wall box. A cover plate has a central opening surrounding the open end of the shroud, openings for passage of fasteners for attaching the cover plate to the adapter plate with the flange in between, and sloping side edges for abutting the wall surrounding the box to form a minimally protruding assembly. A right-angle plug having pin connectors to mate with the receptacle to form a connector assembly with minimum protrusion from the wall is disclosed.

8 Claims, 6 Drawing Sheets

FLUSH MOUNTED RECEPTACLE AND PLUG WITH PIN AND SLEEVE TYPE CONTACTS

This invention relates to an improved, flush-mounted receptacle for receiving a plug wherein the receptacle and plug have pin and sleeve type contacts.

BACKGROUND OF THE INVENTION

Pin and sleeve types of electrical connectors have been developed for a variety of special applications and have proven to be extremely useful and advantageous for a number of reasons. The descriptive name for this type of connector is derived from the construction of the male and female connector portion wherein the electrical contacts in the male part, or plug, are two or more cylindrical, solid, electrically conductive pins which are mounted in the body of the plug and the contacts in the female part, or receptacle, are a corresponding number of electrically conductive sleeves. The pins in the plug are surrounded by a substantially cylindrical protective shroud. The receptacle portion of such a connector includes a generally cylindrical insulating inner body having tubular recesses with the elongated conductive sleeves to receive the pins and a shell which is spaced from the insulating body, leaving an annular gap to receive the shroud. The shroud and shell are provided, respectively, with a key and slot so that the orientation of the shroud with respect to the shell, and with respect to the pin-receiving body of the receptacle, is clearly established.

Additionally, the ground pin of the plug portion of the connector is always larger in diameter than the other pins and the conductive sleeve to receive the ground pin in the receptacle body not only is suitably sized to receive the pin but also reaches further toward the open end of the body than the conductive sleeves adapted to receive the other pins, thereby permitting a ground connection to be established before any other electrical connection is made. Of particular importance is the fact that the shroud surrounding the pins is molded plastic and therefore electrically non-conductive, a characteristic which minimizes the possibility of accidentally coming in contact with the pins while joining the connector portions together.

Pin and sleeve connectors have numerous advantages including the fact that the pin arrangements can be made in a variety of configurations, each configuration being unique to a particular set of voltage, phase and current characteristics. The shroud, as mentioned above, protects the pins from damage and protects the user from accidental contact with the pins. Normally, the receptacle carries the power which is supplied to the plug. Thus, the shroud enters the annular cavity in the receptacle before the power is applied to the pins, providing a further safety feature. The shroud construction tends to exclude foreign materials and the overall construction has been found to be highly durable and reliable.

Such connectors do, however, have some disadvantages as found in the prior art. Because of the cylindrical construction characteristics, the connectors tend to be rather long and bulky. The receptacles have required large, special housings in the form of large boxes which are generally mounted either on the surface of a wall or in a special equipment rack. These boxes also protrude from the surface of the wall a considerable distance, i.e., several inches. Special boxes are required and surface wiring is usually used which for many applications is not as desirable as wiring inside the wall. It would be preferable if at least the more common lower current- and voltage-rated receptacles could be mounted in standard two-gang wall outlet boxes.

Typically, pin and sleeve receptacles of the prior art have mounting flanges which are positioned at a substantial distance from the front face of the receptacle, i.e., an inch or so toward the rear of the outer housing or shell of the receptacle, in order to be able to accommodate hinged covers and the like to close the front of the receptacle when the plug is not plugged into the receptacle and/or to lock the plug to the receptacle against removal. Thus, in addition to the other structural characteristics of the connector which require special boxes, the flange position contributes to the protruding characteristics of the receptacle and the resultant plug-receptacle connective assembly. Characteristically, the receptacle protrudes considerably further from the surface of the electrical outlet box on which it is mounted that its corresponding flat blade counterpart receptacles.

These disadvantages render the use of such connectors unacceptable in many installations where they would otherwise be highly desirable, particularly in work areas in which people frequently must pass close to a wall area.

SUMMARY OF THE INVENTION

Accordingly, an object of the present invention is to provide a pin and sleeve connector wherein the receptacle portion of the connector is constructed so as to be received in a standard, recessed connection box in a wall with the open, front portion of the receptacle being nearly flush with the wall surface.

A further object is to provide such a receptacle which can be mounted as a replacement unit in a conventional recessed connection box and is usable with concealed, in-wall wiring.

Yet another object is to provide such a connector in which the plug portion thereof is constructed with a right-angle cable exit to minimize protrusion of the plug when attached to the receptacle.

Briefly described, in one aspect the invention comprises an improved pin and sleeve receptacle mountable in a wall box recessed in a wall opening of a building with wires extending into the box from an in-wall wiring passage. The receptacle has a generally cylindrical, tubular shell of electrically non-conductive material with an integrally formed closure at one end, the other end being open, a generally cylindrical inner surface, and a mounting flange extending radially outwardly from the outer surface of the shell adjacent the open end, the flange having fastener openings therethrough. A cylindrical inner body has an outer diameter smaller than the first inner diameter, the inner body having electrically conductive female connector sleeves therein and openings at one end for receiving electrically conductive pins of a mating connector. The inner body is mounted within the shell with a substantially uniform annular gap surrounding the inner body between the outer surface thereof and the inner surface of the shell for receiving the shroud of a pin-and-sleeve plug. The openings at one end face in the same direction as the open end of the shell to recieve the pins of the plug. Apertures in the closure admit wires from the box for connection to the electrically conductive female connector means. A cover plate has a central opening surrounding the open end of the shell and sloping side edges for abutting the wall surrounding the box.

In another aspect, the invention is directed to an improved pin and sleeve connector assembly wherein a plug has a generally cylindrical shroud with a central axis and an open end, a first electrically non-conductive body mounted at the other end of the shroud, a plurality of electrically conductive pins carried by and protruding from the body into the shroud, a plug housing attached to the shroud and enclosing the first body, the housing having means defining a cable passage for a cable extending into the housing along an axis perpendicular to the central axis of the shroud, and means carried by the first body for electrically interconnecting wires in the cable and the pins. The mating receptacle is mountable in a wall box recessed in a wall opening of a building with wires extending into the box from an in-wall wiring passage. The receptacle includes a generally cylindrical, tubular shell of electrically non-conductive material having an integrally formed closure at one end with the other end being open and a generally cylindrical inner surface with a first inner diameter. A flange extends radially outwardly from the open end of the shell adjacent the open end, the flange having fastener openings therethrough. A cylindrical inner body has an outer diameter smaller than the first inner diameter, electrically conductive female connector means therein and openings at one end thereof for receiving the electrically conductive pins of the plug. The inner body is mounted within the shell with a substantially uniform annular gap surrounding the inner body between the outer surface thereof and the inner surface of the shell for receiving the shroud of the pin-and-sleeve plug and with the openings at one end facing in the same direction as the open end of the shell to receive the pins of the plug. Apertures through the closure admit wires from the box for connection to the electrically conductive female connector means. An adapte plate has a central opening to receive the shell, a first plurality of holes to receive fasteners extending through the fastener openings in the flange and a second plurality of holes to permit passage of a plurality of fastener means for mounting the plate across the opening of the recessed wall box. A cover plate has a central opening surrounding the open end of the shroud, a plurality of openings for passage of fastener means for attaching the cover plate to the adapter plate with the flange therebetween, and sloping side edges for abutting the wall surrounding the box so that any protrusion is smooth. Thus, when the receptacle is mounted in the recessed box with the plug attached to the receptacle, the connector combination forms an assembly minimally protruding from the wall.

BRIEF DESCRIPTION OF THE DRAWINGS

In order to impart full understanding of the manner in which these and other objects are obtained in accordance with the invention, particularly advantageous embodiments thereof will be described with reference to the accompanying drawings, which form a part of the specification, and wherein.

DESCRIPTION OF THE PREFERRED EMBODIMENTS

Figure 1:
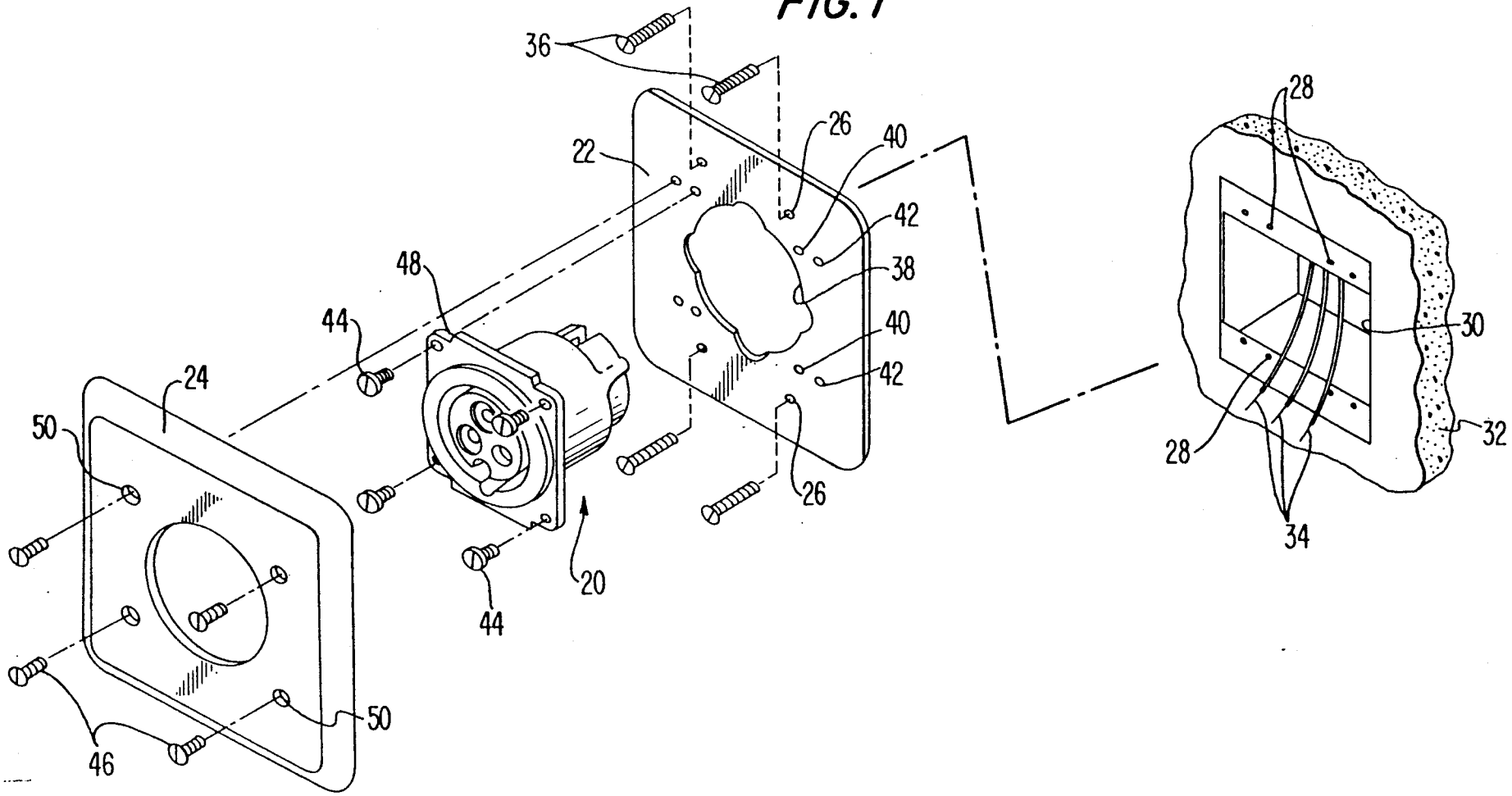
FIG. 1 is a partially exploded, perspective view of a recessed receptacle mounting arrangement in accordance with the present invention.

FIG. 1 shows the major components of a receptacle assembly in accordance with the present invention and a discussion thereof will serve to place the various parts in context. The assembly includes a pin and sleeve receptacle indicated generally at 20, an adapter plate 22 and a wall plate 24. Adapter plate 22 is provided with holes 26 which can be aligned with holes 28 in a conventional, two-gang recessed wall box 30 which is shown mounted in a wall 32. In-wall wiring, leading from a conduit or the like within the wall of the building, terminates in conductors 34 of which there are three illustrated in FIG. 1 for use with a three-wire receptacle 20. Screws 36 pass through holes 26 and attach plate 22 to the wall. A central opening 38 is formed in plate 22 so that the body of receptacle 20 can pass therethrough into box 30.

Plate 22 is also provided with two sets of threaded holes 40 and 42 to receive, respectively, mounting screws 44 and 46 to attach receptacle 20 and wall plate 24 to the adapter plate. For this purpose, receptacle 20 is formed with a flange 48 having openings therethrough for screws 44. Similarly, plate 24 is formed with holes 50 for screws 46.

The assembly of FIG. 1 illustrates a receptacle having a connector configuration for 20 amperes at 125 volts. Adapter plate 22 is provided with an opening 38 shaped to receive that particular receptacle body. FIGS. 2 through 9 illustrate an assembly using a receptacle and plug intended for 30 ampere, three phase 250 volt AC use and therefore having a slightly different configuration. This difference illustrates the nature of the variation in this type of connector and permutations possible with various pin arrangements. There are, in addition, small differences in the configuration of the adapter plate and the like which will be pointed out. The overall assembly arrangement and procedure, however, is substantially the same for the variously rated components.

Figure 2:
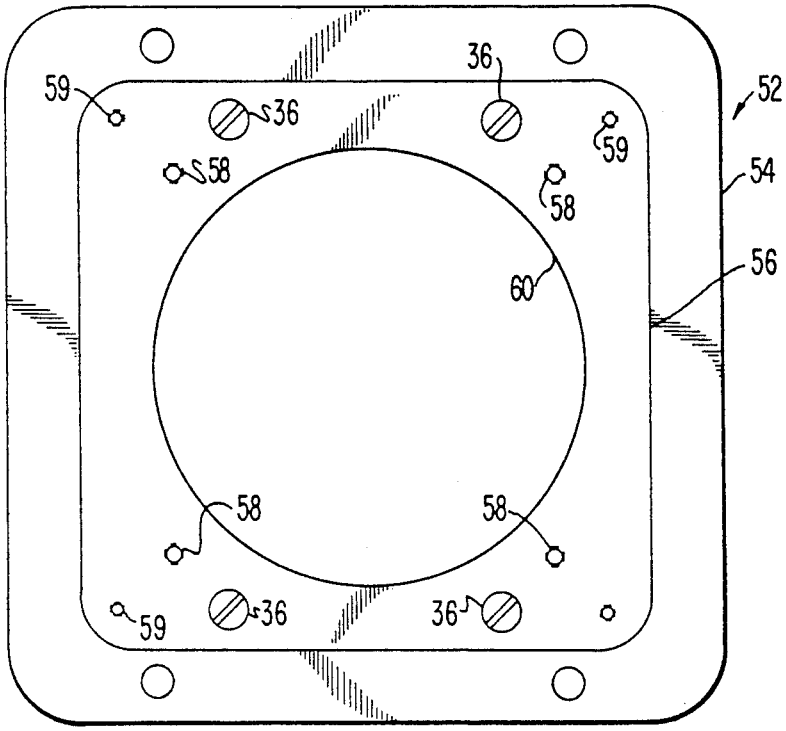
FIGS. 2 and 3 are front and side elevations, respectively, of an adapter plate usable in the assembly of FIG. 1.
Figure 3:
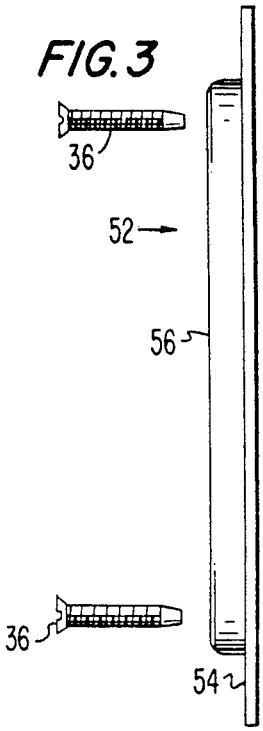

FIGS. 2 and 3 show an adapter plate 52 arranged for use with a 30 ampere, 250 volt AC receptacle. Because the 30 ampere receptacle is slightly deeper in overall size than the 20 ampere receptacle, the adapter plate is formed with a flat, narrow peripheral flange 54 and a central portion 56 which bulges outwardly from the surrounding wall surface a small amount, the plate having a total thickness of approximately 0.31 inches. Central portion 56 is provided with openings to receive screws 36 which attach the plate to the recessed box in the wall, which has a standard threaded hole arrangement, and also two sets 58 and 59 of four internally threaded holes each for receiving screws to attach the receptacle housing and a cover plate, respectively, to the adapter plate. Plate 52 also has a central opening 60 through which the body of the receptacle extends, the opening in this case simply being circular.

Figure 4:
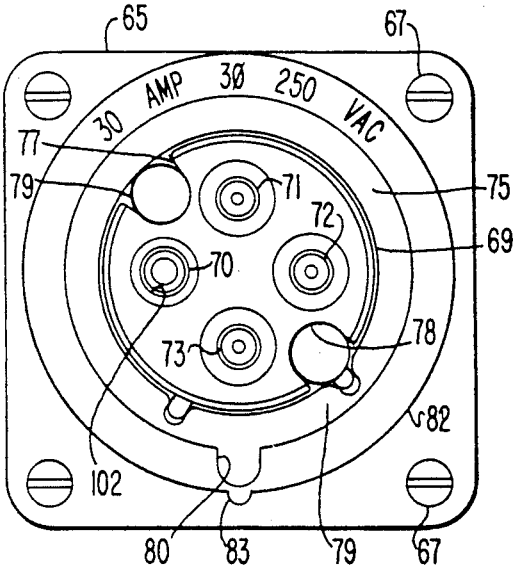
FIGS. 4 and 5 are front and side elevations, respectively, of the receptacle portion of a connector in accordance with the invention usable in the assembly of FIG. 1.
Figure 5:
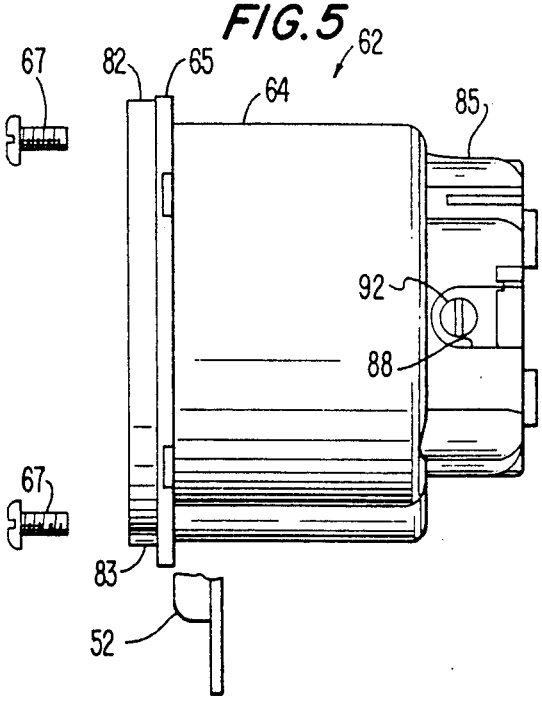

FIGS. 4 and 5 show a receptacle 62 which is mounted in adapter plate 54. The receptacle includes an outer hollow, generally tubular shell 64 which has an open front end, seen in FIG. 4, and which also has a generally outwardly extending flange 65 which has a substantially square periphery. The flange is provided with corner holes through which mounting screws 67 can pass for engagement with holes 58. Of particular importance is the fact that the flange 65 lies in a plane which is at or very close to the plane containing the front face of the openings to the receptacle sleeves.

Shell 64 contains the electrical components of the receptacle and also defines the annular cavity, discussed above, which receives the shroud of the pin and sleeve plug. As seen in FIG. 4, when viewed from the front, the receptacle is seen to have a cylindrical inner body 69 which, in the particular embodiment shown, has four openings 70, 71, 72 and 73, each of which contains a generally cylindrical electrical sleeve to receive one of the pins of the plug portion. Opening 70 is to receive the ground pin and is therefore the largest opening, the other three being of the same size.

The outer surface of cylindrical inner body portion 69 has a smaller diameter than the inner surface of shell 64 and thus forms the inner surface of an annular gap 75 which, as mentioned above, receives the plug shroud. Axially extending grooves 77 and 78 are formed along substantially the full depth of body portion 69 and terminate at members 79 which are unitarily molded with body 69 and which receive screws from the rear which hold body 69 in shell 64. At the lower portion of the shell, at the outer surface of annular gap 75, is a key slot 80 which cooperates with a key on the plug to establish the orientation of the plug relative to the receptacle. A relatively short annular wall 82 protrudes forwardly from the front surface of flange 65 and includes a small key rib 83, the wall and key rib serving to center and properly orient the cover plate. The axial dimension of wall 82 is in the order of 3/16", only slightly more than the thickness of the cover plate.

Figure 6:
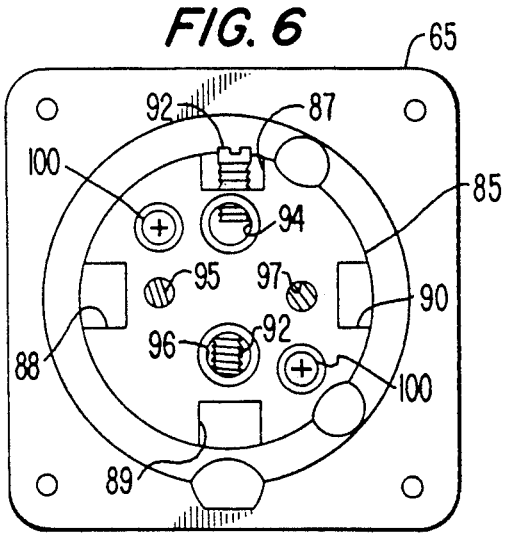
FIG. 6 is a rear elevation of the receptacle portion of FIGS. 4 and 5.

At the rear of body 64 is a reduced-diameter rear portion 85 having a transverse end wall which forms a closure for the hollow shell. The rear portion 85 is formed with openings 87, 88, 89 and 90, best seen in FIGS. 5 and 6, 85 which provide access to the heads of screws 92 which are threaded into electrically conductive members carried by body 69 at the rear portions of the electrically conductive sleeves in openings 70–73. As best seen in FIG. 6, the rear surface of portion 85 has axial openings 94, 95, 96, and 97 into which stripped ends of wires can be inserted and through which the threads of screws 92 can be seen. One screw 92, the head of which is accessible through opening 87 and the threads of which are visible through opening 94, is shown partially extracted to a position permitting the insertion of the stripped end of a wire into opening 94, whereupon the screw 92 is again threaded into the opening to mechanically clamp and electrically engage the end of the wire.

The assembly shown in FIG. 6 includes four access openings 87–90 and four wire insertion openings 94–97 because the particular receptacle involved is a four-wire receptacle. As will be apparent, when the receptacle is designed to receive three wires, then three access openings similar to 87–90 and three wire insertion openings are provided, substantially equally spaced.

Assembly screws 100 penetrate the rear surface of reduced diameter portion 85 and engage members 79 on cylindrical portion 69 to hold the assembly together.

Figure 6A:
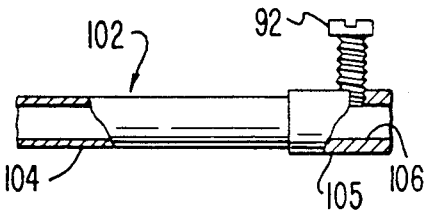
FIG. 6A is a side elevation, in partial section, of a connector member usable in the receptacle of FIGS. 4–6.

FIG. 6A shows one of the electrically conductive members 102 apart from the cylindrical body 69, this member 102 being the ground connector in opening 70. Member 102 is made of a good electrically conductive material such as brass and includes a forward hollow sleeve 104 to receive the ground pin of the plug, and a rear, square portion 105 which has an internal bore 106 to receive a wire and a threaded opening in one side to receive the wire clamping screw 92. The other connectors are substantially identical except that the sleeve portions thereof are smaller in diameter and they are generally made with axially extending splits and a surrounding spring, in a well-known fashion, to provide resilience for the electrical connection.

Figure 7:
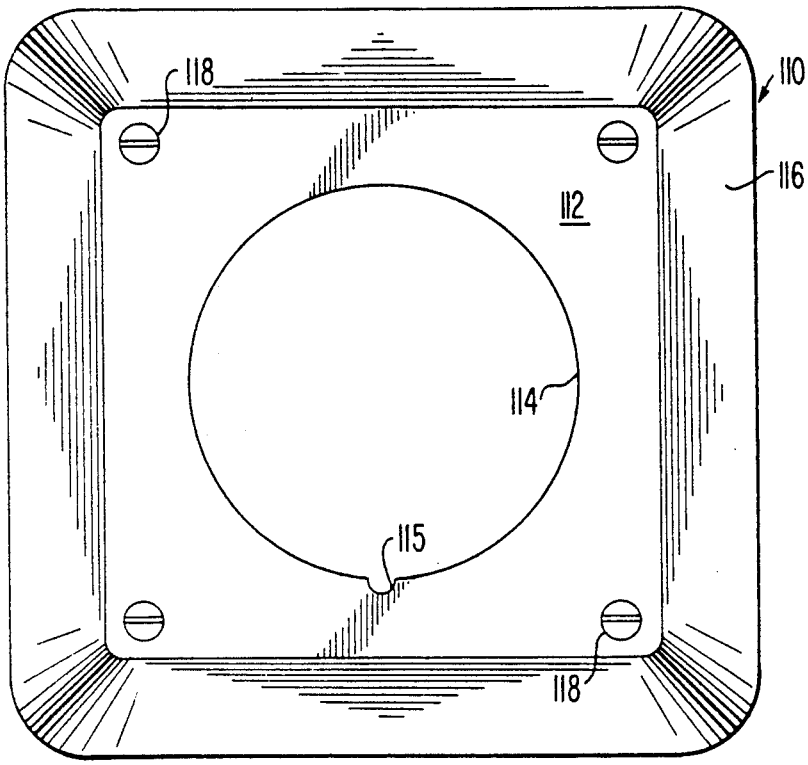
FIGS. 7 and 8 are front and side elevations, respectively, of a wall plate or cover plate usable in the assembly of FIG. 1.
Figure 8:
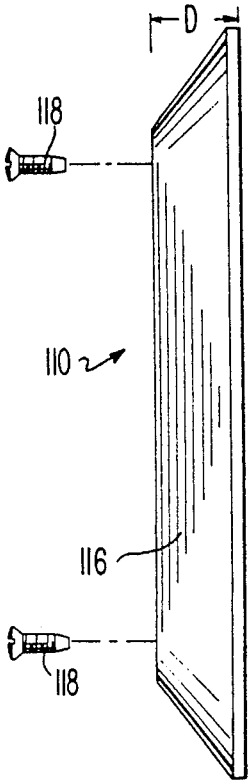

FIGS. 7 and 8 show the wall plate 110 which has a flat face 112 with a central opening 114 to surround wall 82. A notch 115 receives orienting rib 83. Extending outwardly from surface 112 are four sloping wall portions 116 which provide a smooth transition between face 112 and the surrounding wall area. Screws 118 extend through openings in the wall plate to engage threaded holes 59 in the adapter plate. The total thickness of the wall plate depends to some extent upon the rating and size of the receptacle but is, for a 30 ampere receptacle, approximately 0.61 inches.

Figure 9:
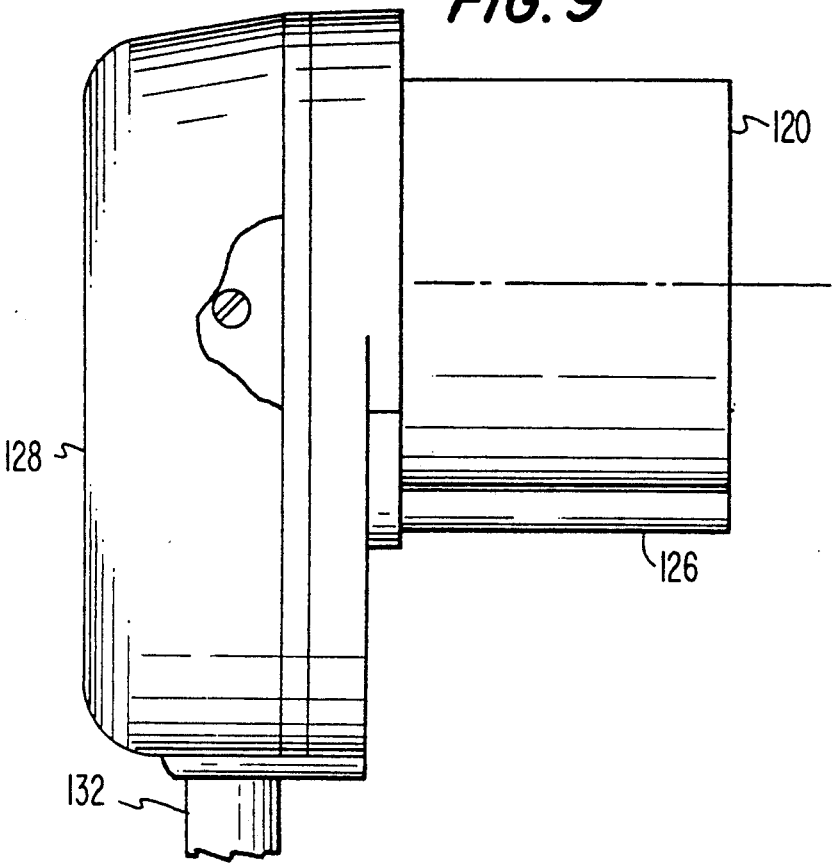
FIGS. 9 and 10 are side and front elevations, respectively, of a plug usable with the receptacle of FIGS. 4–6 in the assembly of FIG. 1.
Figure 10:
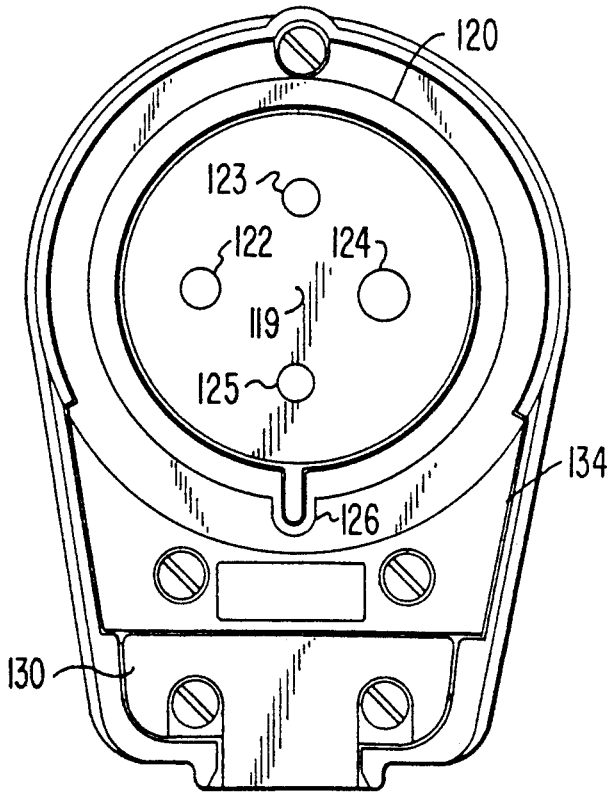

The plug portion of the connector is shown in FIGS. 9 and 10. The plug portion includes an elongated shroud 120 which surrounds the ground and other electrical connection pins 122, 123, 124 and 125 which are arranged around a central longitudinal axis 119 of the shroud to mate with the receptacle sleeves. Shell 120 includes a key 126 which enters key slot 80 to assure proper orientation. A housing 128 includes a cable opening at the lower end thereof and receives a cable clamp 130 to hold cable 132 in position. A cover plate 134 completes the housing.

Within the housing or shell 128, the wires in cable 132 are connected to the ends of pins 122–125 which are held in a non-conductive body in a manner which is substantially identical to that described in connection with the wiring of receptacle 62. The pins are provided with square ends with clamping screws so that wires can be attached thereto in a secure fashion with good electrical and mechanical connection.

Figure 11:
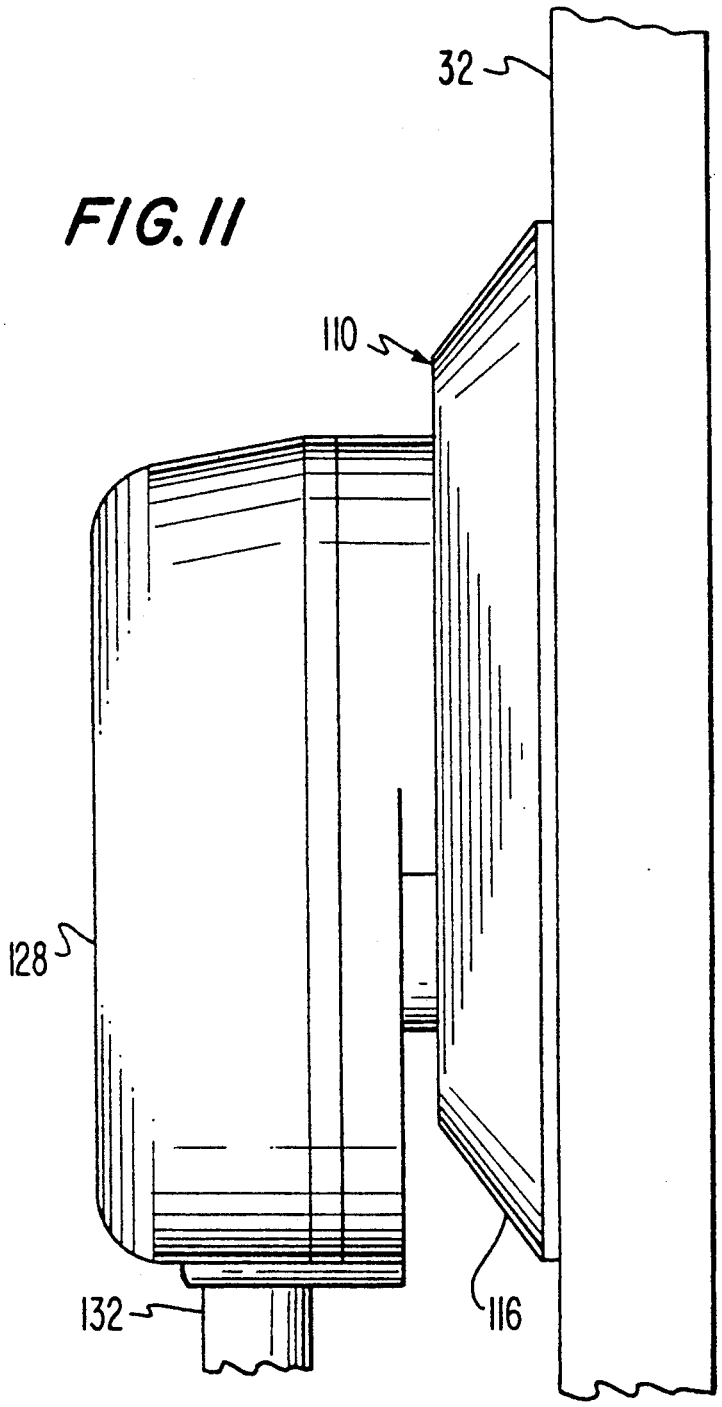
FIG. 11 is a side elevation of a plug plugged into a receptacle in accordance with the invention installed in a building wall.

FIG. 11 shows the plug inserted into a receptacle in accordance with the invention, again using the 30 A. devices as an example. As seen from the side, the edges of wall plate 110 are against the outer surface of a wall in which an electrical box is recessed. Housing 128 of the plug protrudes a minimal distance beyond the wall plate, less than 1.75" in the case of the 30 A. unit. As will be recognized, the provision of a housing which provides a right-angle connection between the pins and the conductors in the cable contributes to the minimal protrusion of the plug from the wall when it is inserted into the receptacle.

Receptacles constructed in accordance with the invention having current ratings of up to 30 amperes and voltage ratings of up to 250 volts AC can be accommodated in a standard two-gang outlet which typically has an interior volume of 38 $in^3$. This feature is important because these levels of current and voltage are commonly used in commerical establishments which have ben wired with standard-sized electrical outlet boxes recessed in the walls of the buildings. Hence, these lower current- and voltage-rated receptacles can be wired into the establishment without the need for surface wiring or special outlet boxes.

In addition, the receptacles will accept plugs having a pin configuration which complies with the International Electrical Code (I.E.C.) standard known by those working in the art as "IEC 309". Thus, appropriate plugs of various manufacturers having pin configurations which conform to this standard may be electrically connected to the instant receptacle.

Figure 12:
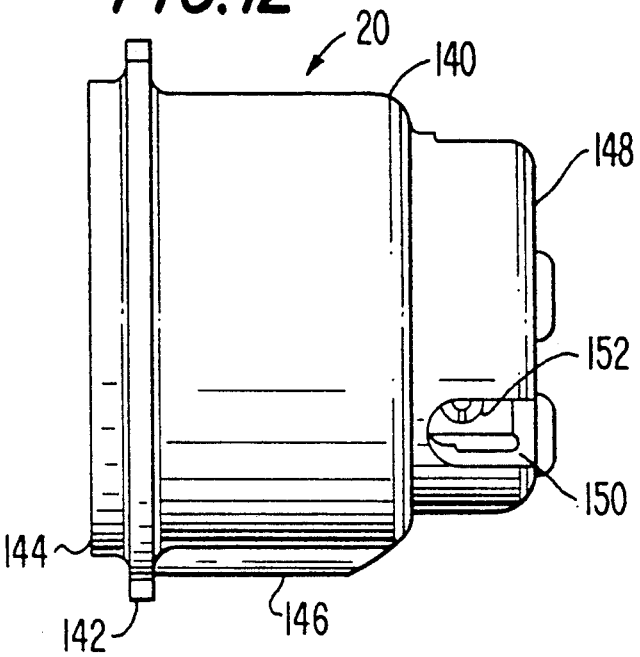
FIG. 12 is a side elevation of the receptacle shown in FIG. 1.
Figure 13:
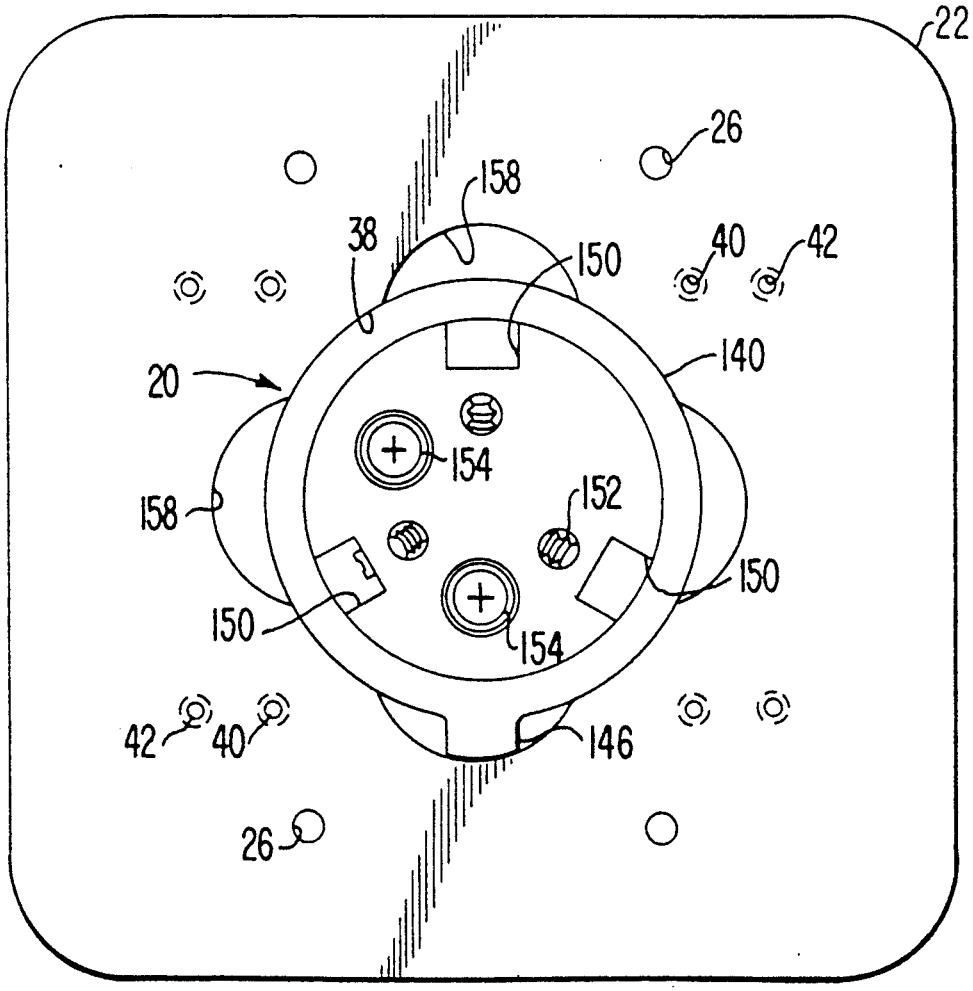
FIG. 13 is a rear elevation of the receptacle of FIG. 1 positioned in the adapter plate of FIG. 1 as it would be mounted.

FIGS. 12 and 13 show the receptacle 20 of FIG. 1, the housing of which is fundamentally similar to the receptacle previously discussed. As seen in FIG. 12, the receptacle has an outer, generally tubular shell 140 which has an open front end to receive a cylindrical inner body, not shown in FIGS. 12 and 13, which is quite similar to body 69 of FIG. 4 except that it has only three sleeves instead of four to carry three sleeve connectors. A flange 142 is formed at the front end of the shell and a short wall 144 protrudes therefrom to position a cover plate.

A rib 146 protrudes radially from one side of shell 140 and extends axially along the outer surface of the shell. At the rear end of the receptacle is a reduced diameter portion 148 which is similar to receptacle 62 in having openings 150 providing access to the heads of wire-clamping screws 152. Mounting screws 154 hold the sleeve-carrying body in the shell.

Surrounding shell 140 in FIG. 13 is adapter plate 22 which has a central opening 38, as seen in FIG. 1, with a diameter slightly larger than the outer diameter of the shell. Plate 22 also has sets of screw holes 26, 40 and 42, previously described. Opening 38 is formed with four lobes 158 which are recesses extending radially outwardly from opening 38 and the centers of which are uniformly separated by angles of about 90°. Any of these openings can receive rib 146. Thus, the lobes permit receptacle 20 to be mounted in the adapter plate in any one of four possible angular orientations.

While certain advantageous embodiments have been chosen to illustrate the invention, it will be understood by those skilled in the art that various changes and modifications can be made therein without departing from the scope of the invention as defined in the appended claims.

What is claimed is:

1. An improved pin and sleeve receptacle mountable in a wall box recessed in a wall opening of a building with wires extending into said box from an in-wall wiring passage, the receptacle comprising the combination of a generally cylindrical, tubular shell of electrically non-conductive material having an integrally formed closure at one end and with the other end being open, a generally cylindrical inner surface having a first inner diameter, and a flange extending radially outwardly from said open end of said shell adjacent said open end, said flange having fastener openings therethrough;

a cylindrical inner body having an outer diameter smaller than said first inner diameter, said inner body having electrically conductive female connector sleeves therein and openings at one end thereof for receiving electrically conductive pins of a mating connector;

means for mounting said inner body within said shell with a substantially uniform annular gap surrounding said inner body between the outer surface thereof and said inner surface of said shell for receiving the shroud of a pin-and-sleeve plug and with said openings at one end facing in the same direction as said open end of said shell to receive the pins of said plug;

means in said closure defining apertures for admitting wires from said box for connection to said electrically conductive female connector sleeves;

a cover plate having a central opening surrounding said open end of said shell, said cover plate having sloping side edges for abutting the wall surrounding said box; and means for supporting said receptacle in said wall box and said cover plate against said receptacle flange and said wall.

2. A receptacle according to claim 1, wherein said means for supporting includes an adapter plate having a central opening to receive said shell, a first plurality of holes in said adapter plate to receive fasteners extending through said fastener openings in said flange, and a second plurality of holes in said adapter plate to permit passage of a plurality of fastener means for mounting said plate across the opening of said recessed wall box;

and wherein said cover plate includes a plurality of openings for passage of fastener means for attaching said cover plate to said adapter plate with said flange therebetween.

3. A receptacle according to claim 2 wherein said adapter plate further includes means defining a plurality of arcuate recesses extending radially outwardly from said central opening;

and wherein said tubular shell includes an outer diameter less than the diameter of said central opening, and an axially extending rib protruding radially from the outer surface of said shell, said rib being dimensioned to be received in one of said arcuate recesses, thereby establishing the circular orientation of said shell.

4. A receptacle according to claim 1 wherein said shell further comprises an annular wall formed on said flange surrounding said open end for positioning said cover plate.

5. A receptacle according to claim 4 wherein said annular wall is provided with a radially protruding key and said central opening in said cover plate is formed with a mating recess to thereby orient said cover plate relative to said outer shell.

6. A receptacle according to claim 1 wherein said cover plate adjacent said central opening and the said one end of said shell are substantially flush.

7. A low-profile pin and sleeve electrical connector system comprising the combination of (A) a right-angle electrical plug having a plurality of substantially parallel, cylindrical male contacts, an annular, elongated shroud of electrical insulating material having a circular cross-sectional shape circumferentially enclosing said male contacts, said shroud having a longitudinal axis and one end of said shroud being open for accessing said male contacts;

an electrical cable having wires electrically connected to said male contacts;

a housing for said cable attached to said shroud and extending at right angles to said longitudinal axis of said shroud; and (B) an electrical outlet box recessed in a wall opening of a building with electrical wires extending into said box from an in-wall wiring conduit, said outlet box having an open side substantially flush with said wall opening; and (C) an electrical receptacle mounted in said outlet box, said receptacle having a plurality of elongated sleeve contacts facing in the same direction as said open side, said sleeve contacts being coaxially aligned with different ones of said male contacts, a generally tubular shell of substantially circular cross-section formed of an electrically non-conductive material positioned circumferentially around said sleeve contacts, said shell having an open end and an inner diameter greater than the outer diameter of said shroud whereby said male and female contacts can be mated upon insertion of said shroud into said shell, a receptacle mounting flange integral with said shell adjacent said open end of said receptacle, fastener means connecting said flange to said open side of said outlet box so that said open end of said receptacle extends from said wall in close proximity therewith whereby the right-angle configuration of said plug and the proximity of said open end of said receptacle with said wall minimizes the projection of said plug from said wall when said plug is inserted into said receptacle.

8. A connector system according to claim 6 wherein said electrical outlet box in said wall opening is a multi-gang outlet box.

* * * * *